US005608919A

United States Patent [19]

Case

[11] Patent Number: 5,608,919

[45] Date of Patent: Mar. 11, 1997

[54] HELMET FLASHLIGHT RETAINER

[76] Inventor: Richard N. Case, 2525 Arapahoe Ave. #E4-277, Boulder, Colo. 80302

[21] Appl. No.: 318,348

[22] Filed: Oct. 5, 1994

Related U.S. Application Data

[63] Continuation of Ser. No. 32,855, Mar. 16, 1993, abandoned.

[51] Int. Cl.[6] ..... A42B 1/24; F21L 15/14

[52] U.S. Cl. ..... 2/422; 2/918; 362/106

[58] Field of Search ..... 2/422, 425, 424, 2/6.2, 10, 905, 906, 918; 362/103, 105, 106, 107, 190, 191

[56] References Cited

U.S. PATENT DOCUMENTS

| | | | |
|---|---|---|---|
| D. 312,706 | 12/1990 | Janesko . | |
| 3,069,539 | 12/1962 | Kidd . | |
| 3,249,271 | 1/1966 | Allbritton . | |
| 4,360,930 | 11/1982 | Blanchard . | |
| 4,638,410 | 1/1987 | Barker . | |
| 4,718,126 | 1/1988 | Slay . | |
| 4,797,793 | 1/1989 | Fields . | |
| 4,817,212 | 4/1989 | Benoit . | |
| 4,887,194 | 12/1989 | Fields . | |
| 4,901,210 | 2/1990 | Hanabusa | 2/422 |
| 4,953,766 | 9/1990 | Cruickshank . | |
| 4,970,631 | 11/1990 | Marshall | 2/422 |
| 4,998,187 | 3/1991 | Herrick . | |
| 5,034,862 | 7/1991 | Liston . | |
| 5,053,932 | 10/1991 | Case . | |
| 5,102,024 | 4/1992 | Boersma et al. . | |
| 5,115,282 | 5/1992 | Smith | 326/105 |
| 5,183,326 | 2/1993 | Case . | |

FOREIGN PATENT DOCUMENTS

| | | | |
|---|---|---|---|
| 0553037 | 7/1993 | France | 2/422 |
| 2107039 | 4/1983 | United Kingdom . | |

*Primary Examiner*—C. D. Crowder
*Assistant Examiner*—Larry D. Worrell, Jr.
*Attorney, Agent, or Firm*—Donald W. Margolis; John R. Wahl

[57] ABSTRACT

A web type mounting pad for a mini-flashlight is removably secured to a helmet with elastic straps having hooks that clip to the helmet rim. In one embodiment three straps (two long one short) secure the mounting pad. In another embodiment a slidable mounting pad slides on one or more elastic straps. In another embodiment a snap on Velcro band holds a removable Velcro mounting pad, and a tether secures the hand held flashlight to the helmet.

16 Claims, 3 Drawing Sheets

HELMET FLASHLIGHT RETAINER

CROSS REFERENCED PATENTS

This application is a continuing application of U.S. application Ser. No. 08/032,855 filed Mar. 16, 1993, now abandoned.

FIELD OF THE INVENTION

The present invention relates to flashlight retainers for helmets, hard hats, military helmets, fire hats and the like.

BACKGROUND OF THE INVENTION

Hard hats or helmets are used to protect the user's head in hazardous environments. These environments include factories, combat, fires and construction sites. These environments are often dark, thus requiring a flashlight to enable the user to see. It is necessary, therefore, to provide a hard hat or helmet with a flashlight.

These hazardous environments can cause the user to bump his head. Therefore, any flashlight attached to a hard hat or helmet must be secure enough to withstand bumps. Also, the flashlight must be adjustable as to the angle of forward direction to enable the user to illuminate his work area.

Below are noted some prior art efforts at providing a flashlight on a hard hat or helmet.

U.S. Pat. No. 4,817,212 (1989) to Benoit discloses a rubber water sports helmet having a flashlight housed in an upper cavity. An alternate embodiment discloses a bicycle helmet having a pair of waterproof flashlights permanently affixed thereto. These are not removable nor are they adjustable. They are also relatively expensive to manufacture.

U.S. Pat. No. 4,998,187 (1991) to Herrick discloses a hard hat or helmet headlamp holder. A base plate is riveted to the hard hat. A swivel mount holds a headlamp brace which aligns a flashlight forward. This invention requires altering the original hard hat or helmet.

U.S. Pat. No. 3,069,539 (1962) to Kidd discloses a miner's hard hat having a metal retaining bracket for a flashlight. The hard hat is fitted with a permanently mounted frontal transverse clip. Once again, the original hard hat must be altered to accommodate the flashlight.

U.S. Pat. No. Des. 312,706 to Janesko (1990) as illustrated by J & L Supply, Hasbrook Heights, N.J., discloses a clip on flashlight holder for a fire hat or other hard hat. If dropped, then the clip would fall off. In summary the prior art does not teach a removable flashlight holder for a helmet (helmet and hard hat are synonymous herein) which can accommodate a wide range of flashlight sizes and styles, withstand bumps, adjust the angle of light, and mount to any helmet without altering the helmet. The present invention provides all of the above noted features in an inexpensive embodiment utilizing fabrics.

SUMMARY OF THE INVENTION

The main object of the present invention is to provide a removable flashlight retainer for helmets that does not require altering the helmet.

Another object of the present invention is to provide an inexpensive embodiment of the above noted invention utilizing fabrics which are lightweight and easily stored.

Another object of the present invention is to provide a universally adaptable rapid mount embodiment using three clips hooked to the rim of any helmet.

Another object of the present invention is to provide a means for holding a flashlight which is so versatile that the means will accommodate a wide range of flashlight sizes.

Another object of the present invention is to provide a means for adjusting the flashlight to illuminate the user's work area.

Other objects of this invention will appear from the following description and appended claims, reference being had to the accompanying drawings forming a part of this specification wherein like reference characters designate corresponding parts in the several views.

The preferred embodiment uses a rectangular fabric mounting base having elastic retaining loops for accommodating various sizes of mini-flashlights. Three plastic mounting hooks support the mounting base on any helmet by clipping to the rim. The hooks are attached to one short non-elastic strap and two long elastic straps. The two long elastic straps project outwardly preferably at a 45 angle from the top of the mounting base. The short non-elastic strap is affixed to the bottom of the mounting base. Adjustment of the forward angle is accomplished by moving the straps along the hat rim.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
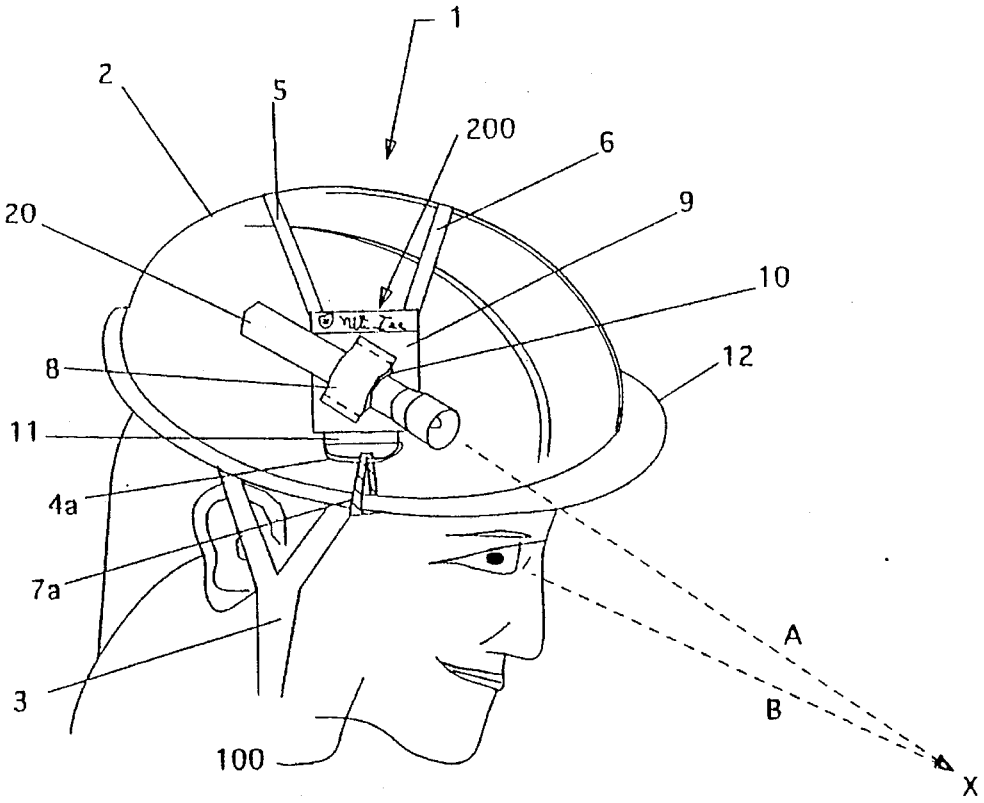
FIG. 1 is a top left side perspective view of a helmet flashlight retainer.

Referring first to FIG. 1 a helmet 1 is secured to the user 100 by means of a conventional chin strap 3. The helmet 1 has a top 2 and a rim 12. A helmet flashlight retainer 200 is mounted atop the helmet 1.

The helmet flashlight retainer has a mounting base 9. A short mounting strap 11 depends from the bottom of mounting base 9. A hook retaining loop 4*a* depends from the short mounting strap 11. A hook 7*a* depends from the hook retaining loop 4*a*. Hook 7*a* clips onto the rim 12 of helmet 1. Elastic straps 5, 6 project upwardly from the mounting base 9. They terminate in hook retaining loops 4*c*, 4*b* and hooks 7*c*, 7*b* as seen in FIG. 2.

Figure 3A:
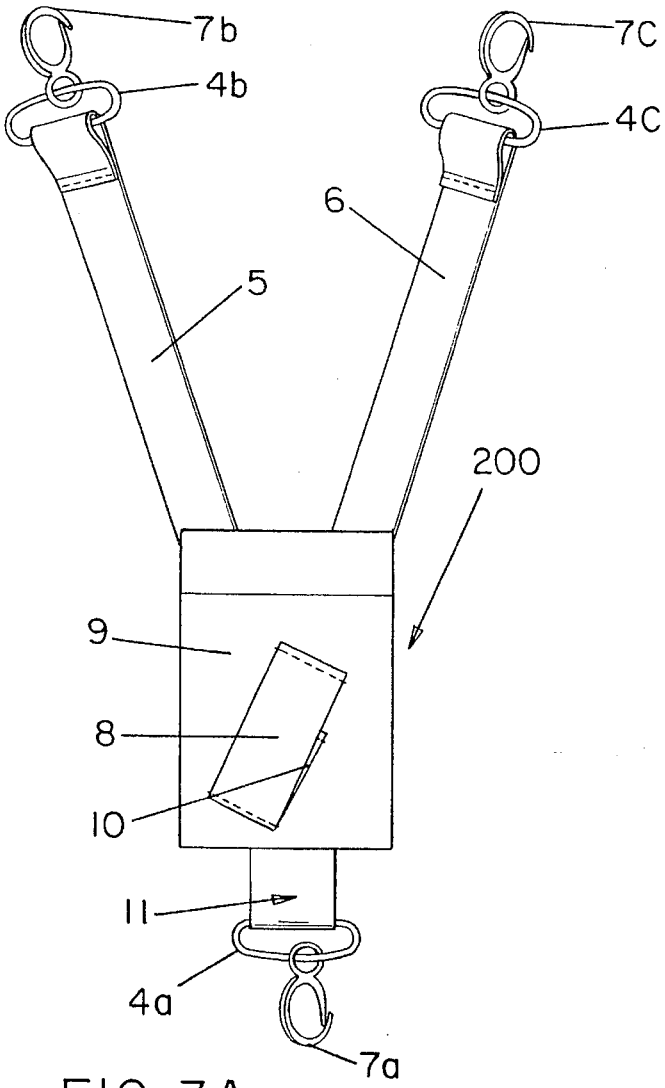
FIG. 3A is a front plan view of an unmounted helmet flashlight retainer.
Figure 3B:
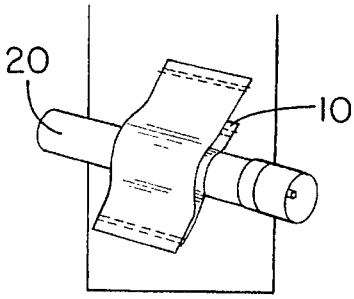
FIG. 3B is an enlarged view of the mounting pad showing the double retaining loops for retaining different sizes of flashlights, and showing a cylindrical mini-flashlight retained in the smaller loop.
Figure 3C:
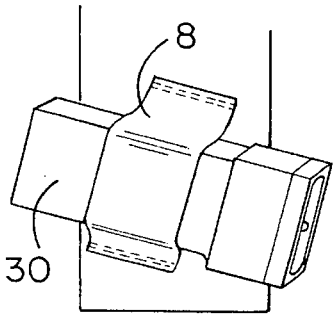
FIG. 3C is an enlarged view of the mounting pad showing a larger flashlight than in FIG. 3B retained in the larger loop.

A pair of elastic retainer loops 8, 10 are sewn to the mounting base 9. Loop 8 is larger than loop 10 and can accommodate larger diameter mini-flashlights as seen in FIG. 3. Loop 10 can accommodate a smaller diameter mini-flashlight 20.

The angle A of mini-flashlight 20 can be adjusted with respect to the user's line of sight B to a work object X. The movement of hooks 7*a*, 7*b*, 7*c* change the angle A.

Figure 2:
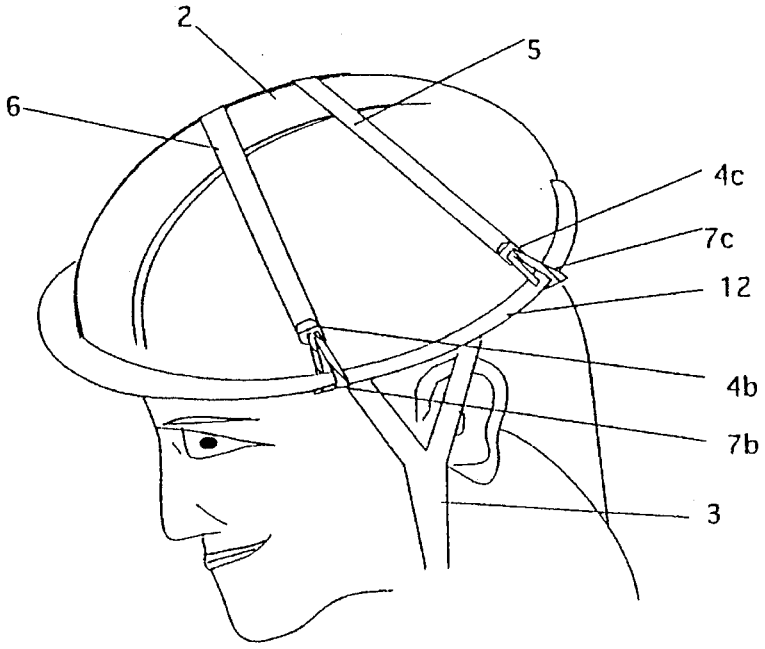
FIG. 2 is a top right side perspective of the helmet of FIG. 1 showing the two long elastic mounting straps of the helmet flashlight retainer.

Referring next to FIG. 2 the elastic straps 5, 6 and hooks 7*b*, 7*c* can be moved at any desired position along rim 12. The elasticity of elastic straps 5, 6 allow for fitting over various types of helmets including firehats having broad outwardly extending rims. It is known in the art that elastic straps 5, 6 could be replaced by equivalent belt buckle style non-elastic straps.

Referring next to FIG. 3 the mounting base 9 is made out of a heavy durable non water absorbent fabric webbing such as nylon or polypropylene. The loops 8, 10 are elastic straps which are sewn into the mounting base 9. Short mounting strap 11 is non-elastic. It is sewn into the mounting base 9. The hooks 7*a*, 7*b*, 7*c* are made of nylon such as the brand Acetal. These hooks must have good memory retention. Metal or equivalent hooks could be used. The hook retaining loops are made of a non-elastic cord such as a parachute cord fused together. Mini-flashlight 20 is retained by strap 10. Mini-flashlight 30 is retained by strap 8.

Figure 4:
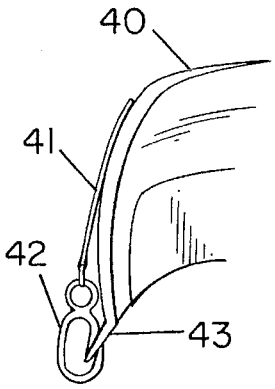
FIG. 4 is a sectional view of a helmet showing the clip mounting on the rim of the helmet.

Referring next to FIG. 4 the rim 43 of a helmet 40 protrudes outwardly. A hook 42 of a helmet flashlight retainer (not shown) is latched to the rim 43. An elastic strap 41 holds the hook 42 snugly against rim 43.

Figure 5:
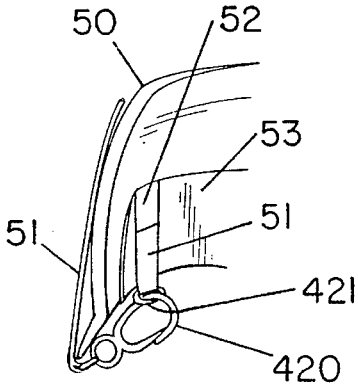
FIG. 5 is a sectional view showing an alternate embodiment of a mounting strap using a Velcro loop around the inner suspension strap of the helmet.

Referring next to FIG. 5 a helmet 50 has a conventional inner suspension band 53. An alternate embodiment of securing strap 51 is shown. Strap 51 has a hook 420 secured to it. A matching retaining loop 421 is attached to a flexible inner strap 51 which has an adjustable hook and loop fastener such as a Velcro® fastener 52. This embodiment eliminates the necessity of affixing anything to the helmet rim.

Figure 6:
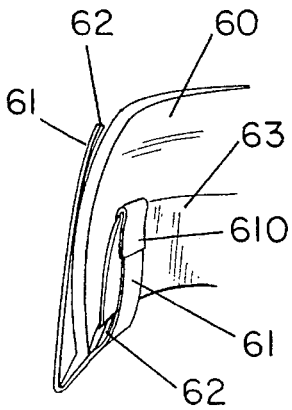
FIG. 6 is a sectional view showing an alternate embodiment of a mounting strap using a continuous loop of a fabric strap around the inner suspension strap of the helmet.

Referring next to FIG. 6 a helmet 60 has a conventional suspension band 63. Mounting strap 61, 62 has no hooks. Instead it wraps around suspension band 63. Mounting strap 61, 62 has no loops. Instead it wraps around suspension band 63. Hook and loop fasteners join the strap members 61, 62 forming a joint at 610. User's concerned with jagged edges that might snag an object can thus have an all fabric mounting means. Mounting strap 61, 62 could be either elastic and universally mountable or non-elastic and sized for a particular helmet. This embodiment would also work well with a bicycle helmet which has no sharp edged rim capable of securing hooks.

Figure 7:
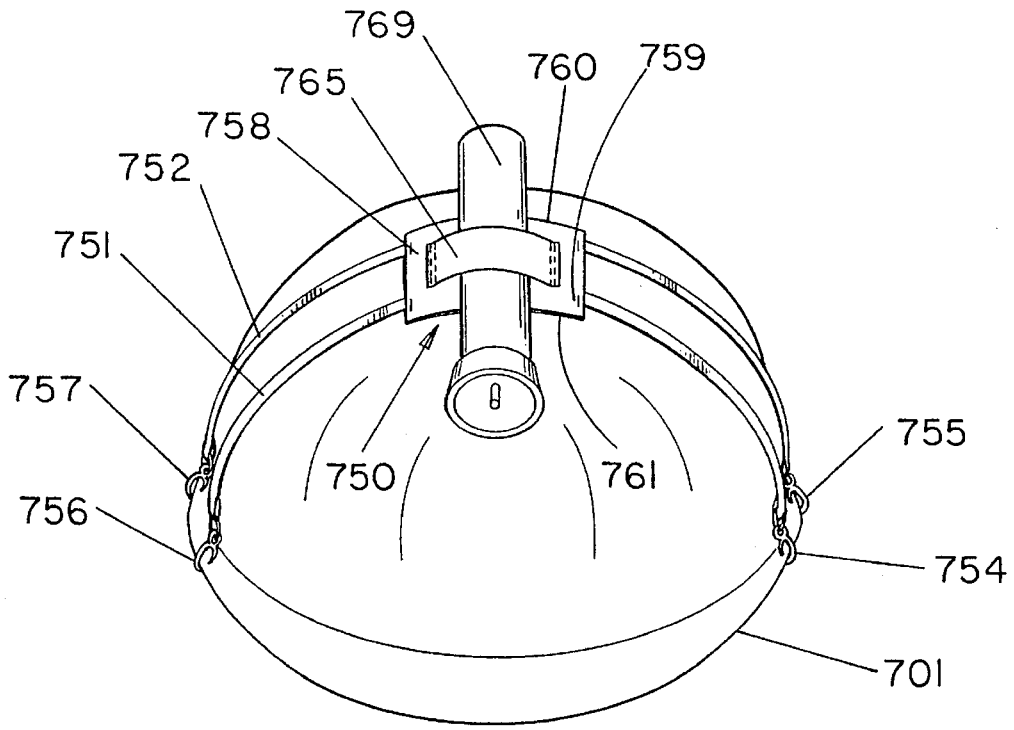
FIG. 7 is a top perspective view of an alternate embodiment having a sliding mounting pad.

Referring next to FIG. 7 a helmet 700 has a rim 701. An adjustable flashlight retainer 750 is slidably engaged along elastic straps 751, 752. Hooks 754, 755, 756, 757 secure the straps 751, 752 to the rim 701. Pockets 758,759 are sewn into mounting pad 760. A non-slip rubber surface 761 is affixed to the bottom surface of mounting pad 760. A retainer loop 765 secures a large diameter flashlight 769. In operation the flashlight retainer 750 is removed from the helmet 700. The mounting pad 760 is slidably adjusted along straps 751, 752 to be positioned anywhere on the helmet 700. It can be mounted on top or left or right to best accommodate the user. The non-slip surface 761 helps secure the mounting pad 760 to the helmet 700. Any above noted combinations of securing means or multiple retainer loop configurations are possible with this embodiment.

Figure 8:
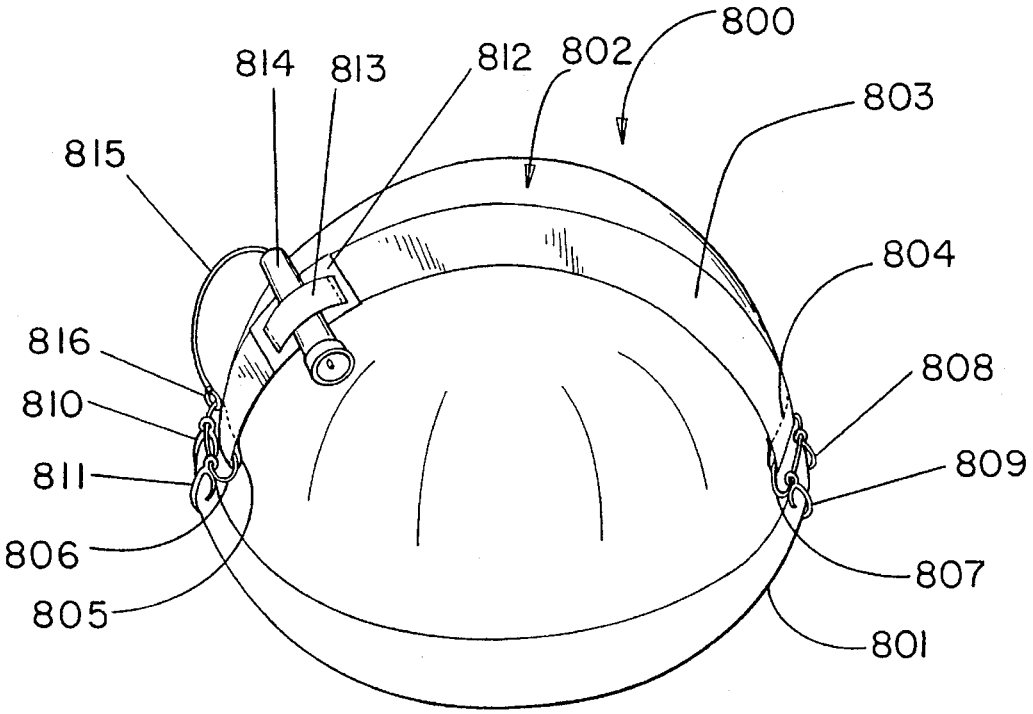
FIG. 8 is a top perspective view of an alternate embodiment having a removable Velcro mounting pad.

Referring last to FIG. 8 a helmet 800 has a flashlight retainer 802 made of one large hook and loop band 803. Pockets 804, 805 are sewn into band 803. They support elastic loops 806, 807 which in turn support hooks 808,809, 810,811. These hooks attach to rim 801. A hook and loop mounting pad 812 is removably affixed to band 803 anywhere along its length. A retainer loop 813 secures flashlight 814 to mounting pad 812. A tether 815 secures flashlight 814 to elastic loop 806 by means of a hook 816. In operation the mounting pad 812 can be either accidentally dismounted or removed from band 803 for hand held flashlight use yet secured to the helmet 800 by means of the tether 815. This embodiment could be useful in mines or other dark environments where a hand held flashlight could be useful.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A flashlight holding assembly, including no horizontal headband components, said assembly adapted to be mounted on to a helmet having a top, side surfaces and a substantially continuous circumferential rim below the side surfaces of the helmet, said flashlight holding assembly including:

a mounting base pad having a top surface, a bottom surface, an upper edge, and a lower edge, said bottom surface of said mounting base pad adapted to be positioned against and slidingly engage a side surface of a helmet;

at least one flashlight retainer loop carried on said top surface of said mounting base pad;

first and second mounting straps, each said first and second mounting straps having a proximal end and a distal end, each of said proximal ends connected to and extending from said upper edge of said mounting base pad;

a third mounting strap having a proximal end and a distal end, said proximal end connected to and extending from said lower edge of said mounting base pad;

first, second and third attaching means connected at said distal ends of said first, second and third mounting straps, respectively, each of said attaching means adapted to be removably connected to a substantially continuous portion of a rim of a helmet; whereby, by connecting said third removable attaching means to the rim of a helmet with said bottom surface of said mounting base pad positioned to slidingly engage a portion of the side of the same helmet, and with at least one said flashlight retainer loop carried on said top surface of said mounting base pad and accessible to receive and hold a flashlight, and extending said first and second mounting straps over the top of the same helmet to portions of the side of the helmet which are substantially opposed to said mounting base pad, and by connecting said first and second removable attaching means to spaced apart portions of the continuous rim which are also spaced from said third removable attaching means, so that a secure mounting for the mounting base pad on a helmet and for any flashlight carried by said at least one said flashlight retainer loop carried on said top surface of said mounting base pad may thereby be provided.

2. The assembly of claim 1 wherein said first and second mounting straps extending from said upper edge of the mounting base pad each further comprise two elongated elastic members projecting at an angle from said upper edge of the mounting base pad.

3. The assembly of claim 1 wherein said first, second and third means for removably attaching said assembly to the rim of a helmet further comprise hooks affixed to said distal ends of said first, second and third mounting straps, respectively, said hooks functioning to removably attach said straps to a substantially continuous portion of a rim of a helmet.

4. The assembly of claim 1 wherein said proximal ends of said first, second and third straps are sewn to said mounting base pad.

5. The assembly of claim 2 wherein said elongated elastic members each further include adjustment means for adjusting the length of said elastic members.

6. A combination including:

a helmet having a top, side surfaces and a substantially continuous circumferential rim below said side surfaces of said helmet, and a flashlight holding assembly, including no horizontal headband components, said flashlight holding assembly adapted to be mounted on to said helmet, said flashlight holding assembly including a mounting base pad having a top surface, a bottom surface, an upper edge, and a lower edge, said bottom surface of said mounting base pad adapted to slidingly engage a side surface of said helmet; at least one flashlight retainer loop carried on said top surface of said mounting base pad; first and second mounting straps, each said first and second mounting straps having a proximal end and a distal end, each of said proximal end connected to and extending from said upper edge of said mounting base pad; a third mounting strap having a proximal end and a distal end, said proximal end connected to and extending from said lower edge of said mounting base pad; first, second and third attaching means connected at said distal ends of said first, second and third mounting straps, respectively, each of said attaching means adapted to be removably connected to a substantially continuous portion of said rim of said helmet; whereby, by connecting said third removable attaching means to said rim of said helmet with the said bottom surface of said mounting base pad positioned to slidingly engage a portion of said side of portion of said helmet, and with at least one said flashlight retainer loop carried on said top surface of said mounting base pad and accessible to receive and hold a flashlight, and said first and second mourning straps extending over the top of said helmet to portions of the side which are substantially opposed to said mounting base pad, and by connecting said first and second removable attaching means to spaced apart portions of said rim which are also spaced from said third removable attaching means, so that a secure mounting for the mounting base pad on said helmet, and for any flashlight carried by said at least one said flashlight retainer loop carried on said top surface of said mounting base pad may thereby be provided in combination.

7. A flashlight mounting assembly, including no horizontal headband components, said assembly adapted to be mounted on a helmet having a top and a continuous rim around said top, said flashlight mounting assembly, including:

a strap having a first and second end and a top surface and a bottom surface, said bottom surface adapted to engage the top of a helmet;

hook and loop type material carried on said top surface of said strap;

means for attaching said first and second ends of said strap to a continuous rim of a helmet so as to place said strap over the top of a helmet;

a mounting base pad having a top surface and a bottom surface;

hook and loop type material carried on said bottom surface of said mounting base pad, said hook and loop type material being complementary to said hook and loop type material carried on said top surface of said strap; and at least one flashlight retainer loop carried on said top surface of said mounting base pad.

8. The assembly of claim 1 further comprising a tether adapted to be affixed to a flashlight and to said mounting pad.

9. The assembly of claim 7 wherein said means for attachment further comprise hooks affixed to said first and second ends of said strap for engagement with a rim of a helmet.

10. A flashlight holder for securing a flashlight to a generally dome shaped top of a helmet having a continuous rim around said top, said holder comprising:

a mounting pad portion having an upper surface, an under surface, a top edge and a bottom edge, said upper surface having mounted thereon at least one elastic strap forming with said base pad a sleeve for removably receiving a flashlight therein;

a first strap member having a proximal end attached to said bottom edge of said mounting pad portion and extending from said bottom edge of said mounting pad portion, said first elongated strap member also having a distal end carrying a first attachment means for engaging a portion of a continuous rim of a helmet; and at least one elongated strap member having a proximal end attached to said top edge of said mounting pad portion and extending from said top edge of said mounting pad portion, said elongated strap member also having a distal end carrying a second attachment means for engaging a portion of a continuous rim of a helmet, said elongated strap member adapted to extend substantially over the top of a helmet when said flashlight holder is installed on a helmet.

11. The holder according to claim 10 further comprising a second elongated strap member extending from said top edge of said mounting pad and including a third attachment means for engaging a portion of a continuous rim of a helmet, said second elongated strap member also adapted to extend substantially over the top of a helmet when said holder is installed on a helmet.

12. The holder according to claim 11 wherein said elongated strap members extend at an angle from one another from said top edge of said mounting pad.

13. The holder according to claim 12 wherein said elongated strap members are elastic.

14. The holder according to claim 12 wherein said attachment means are hooks having a portion fastened to said distal end of said straps and a portion engagable with the rim of a helmet.

15. The holder according to claim 12 wherein said first and second elongated strap members are made of a stretchable material.

16. The holder according to claim 12 wherein said top surface of said mounting pad carries two elastic straps thereon each sized to receive a flashlight having a different diameter.

* * * * *